US007762001B2

(12) United States Patent
Morisugi et al.

(10) Patent No.: US 7,762,001 B2
(45) Date of Patent: Jul. 27, 2010

(54) HAIR CLIPPER

(75) Inventors: Kazuhiro Morisugi, Inukami (JP); Toshio Ikuta, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 313 days.

(21) Appl. No.: 12/003,252

(22) Filed: Dec. 21, 2007

(65) Prior Publication Data

US 2008/0172885 A1 Jul. 24, 2008

(30) Foreign Application Priority Data

Dec. 22, 2006 (JP) ..... 2006-346539

(51) Int. Cl.
*B26B 19/06* (2006.01)

(52) U.S. Cl. ..... 30/216; 30/34.1; 30/123

(58) Field of Classification Search ..... 30/34.1, 30/43.92, 122, 123, 208, 216
See application file for complete search history.

(56) References Cited

U.S. PATENT DOCUMENTS

| | | | | |
|---|---|---|---|---|
| 1,997,096 | A * | 4/1935 | Andis | 30/199 |
| 3,672,049 | A | 6/1972 | Demci et al. | |
| 4,581,822 | A * | 4/1986 | Fujimura | 30/216 |
| 5,367,772 | A | 11/1994 | Ogawa | |
| 6,378,210 | B1 | 4/2002 | Bickford | |
| 7,188,422 | B2 * | 3/2007 | McCambridge et al. | 30/123 |
| 7,426,785 | B2 * | 9/2008 | Ho | 30/43.92 |
| 2002/0000043 | A1 | 1/2002 | Beutel et al. | |
| 2002/0083595 | A1 | 7/2002 | Ullmann | |
| 2004/0049921 | A1 | 3/2004 | Freas et al. | |
| 2007/0209211 | A1 | 9/2007 | Pragt et al. | |
| 2007/0289138 | A1 | 12/2007 | Worgull | |

FOREIGN PATENT DOCUMENTS

| | | | |
|---|---|---|---|
| JP | 51-130293 | | 10/1976 |
| JP | 58-61777 | | 4/1983 |
| JP | 5-317537 | | 12/1993 |
| JP | 11-197373 | * | 7/1999 |
| JP | 2002-532213 | | 10/2002 |
| JP | 2008-142344 | * | 6/2008 |
| WO | WO 02/36314 | | 5/2002 |
| WO | WO 2005/053916 | | 6/2005 |
| WO | WO 2005/092579 | | 10/2005 |

* cited by examiner

*Primary Examiner*—Hwei-Siu C Payer
(74) *Attorney, Agent, or Firm*—Bacon & Thomas, PLLC

(57) ABSTRACT

A hair clipper includes three blade blocks each including comb-like blades mutually overlapped for making sliding contact with each other, each blade block having a skin contact surface parallel to a projecting direction of the comb-like blades; and a main body including a drive unit for reciprocating one of the comb-like blades. The blade blocks include first, second and third blade blocks. The second blade block has a skin surface contact angle between a longitudinal axis of the main body and the skin contact surface acute and greater than that of the first blade block. The third blade block has a skin surface contact angle same as that of the second blade block. The third blade block has a cutting width smaller than that of the first and second blade blocks. The main body includes an attachment unit for detachably attaching one of the blade blocks to the main body.

7 Claims, 19 Drawing Sheets

HAIR CLIPPER

FIELD OF THE INVENTION

The present invention relates to a hair clipper in which a plurality of blade blocks can be replaceably attached to a single main body and, more specifically, to a technique of making it possible to readily cut hairs in any region in adaptation to different characteristics of hair regions.

BACKGROUND OF THE INVENTION

Conventionally, a hair clipper includes a plurality of blade blocks replaceably attached to a single main body. The blade blocks are region-specific blade blocks for use in cutting hairs of head and other body portions. One of the blade blocks is selected and attached to the main body, the selection of which is made in adaptation to the hair density of hair regions (see, e.g., Japanese Patent Laid-open Application No. H11-197373).

In the conventional case noted above, the cutting width of one of the blade blocks is generally equal to the width of a blade attachment portion of the main body. The reason for this is to cut hairs by making the width of each blade block as broad as possible.

However, the characteristics of the hair regions vary with the shape thereof as well as the hair density. In particular, sensitive regions such as the armpit and the genital region have a feature that they exhibit severe irregularities as compared to other regions and tend to be narrow-spaced due to the presence of the arms and the legs.

In case the hair regions of different characteristics are subjected to haircut, use of a general-purpose blade block with an increased width hinders the haircut because the width thereof is too wide and the opposite side portions come into contact with the human body. In order to avoid such contact with the human body, there is a need to incline the blade block together with the main body, thus making the hair clipper less convenient to use. This poses a problem in that the hair regions of different characteristics cannot be satisfactorily subjected to haircut.

SUMMARY OF THE INVENTION

In view of the above, the present invention provides a hair clipper that is capable of adapting itself to different characteristics of hair regions, particularly, narrow-spaced irregular regions such as the armpit and the genital region, thereby satisfactorily performing haircut in any region with ease.

In accordance with an embodiment of the present invention, there is provided a hair clipper, including: at least three blade blocks each including a plurality of comb-like blades mutually overlapped for making sliding contact with each other, each of the blade blocks having a skin contact surface generally parallel to a projecting direction of the comb-like blades; and an elongated main body including a drive unit for reciprocating at least one of the comb-like blades, wherein blade blocks include a first blade block, a second blade block whose skin surface contact angle between a longitudinal axis of the main body and the skin contact surface is acute and is greater than a skin surface contact angle of the first blade block, and a third blade block having a skin surface contact angle which is substantially the same as the skin surface contact angle of the second blade block, the third blade block having a cutting width smaller than a cutting width of the first blade block and the second blade block, and wherein the main body includes an attachment unit for detachably attaching a selected one of the plurality of blade blocks to the main body.

With this configuration, the hair clipper includes at least three blade blocks, one of which is selected and used in combination with a single main body. This helps reduce the overall costs involved in manufacturing the hair clipper. Particularly, the skin surface contact angle of the second blade block between the longitudinal axis of the main body and the skin contact surface is acute and is greater than that of the first blade block. Thus, the second blade block can be erected at an angle greater than that of the first blade block to cut the hairs. The first blade block is used in cutting the hairs of the generally spherical head, while the second blade block is used in cutting the hairs of the hands, the legs, the chest, the torso and the like. This makes it easy to use the first and the second blade blocks. Moreover, the third blade block has substantially the same skin surface contact angle as that of the second blade block so that it can be used with ease. With the third blade block, the cutting width of the comb-like blades is narrower than that of the first and second blade blocks. Therefore, the sensitive regions such as the armpit and the genital region, which are irregular and narrow-spaced, can be concentratedly shaved as desired without contact of the crosswise opposite ends of the comb-like blades with the user's body which could hinder the haircut operation. Accordingly, it is possible to increase the efficiency of haircut operation.

Preferably, the third blade block has a counterpart attachment portion attached to the main body and an operating portion including the comb-like blades and the skin contact surface, the operating portion having a width smaller than a width of the counterpart attachment portion so that indented portions are formed on opposite sides of the third blade block.

With this configuration, the third blade block has indented portions on the opposite sides thereof. This makes it possible to avoid the third blade block from contacting a bulged body portion present in the irregular and narrow-spaced hair regions, such as the armpit and the genital region, thereby allowing the hair clipper to be used with ease.

Preferably, the third blade block has a distance between the skin contact surface and the counterpart attachment portion greater than a corresponding distance of the first blade block and the second blade block.

With this configuration, the counterpart attachment portion of the third blade block attached to the main body can be kept distant from the skin when the skin contact surface of the third blade block is brought into contact with the skin. Accordingly, it is possible to concentratedly shave a deeply recessed hair region as desired while the haircut operation is not hindered by the counterpart attachment portion having an increased width.

In a nutshell, the hair clipper of the present invention is capable of adapting itself to different characteristics of hair regions, particularly, narrow-spaced regions with irregularities such as the armpit and the genital region, thereby satisfactorily performing haircut in any region with ease.

BRIEF DESCRIPTION OF THE DRAWINGS

The objects and features of the present invention will become apparent from the following description of preferred embodiments given in conjunction with the accompanying drawings, in which.

DETAILED DESCRIPTION OF THE EMBODIMENTS

Hereinafter, embodiments of the present invention will be described with reference to the accompanying drawings which form a part hereof.

Figure 1:
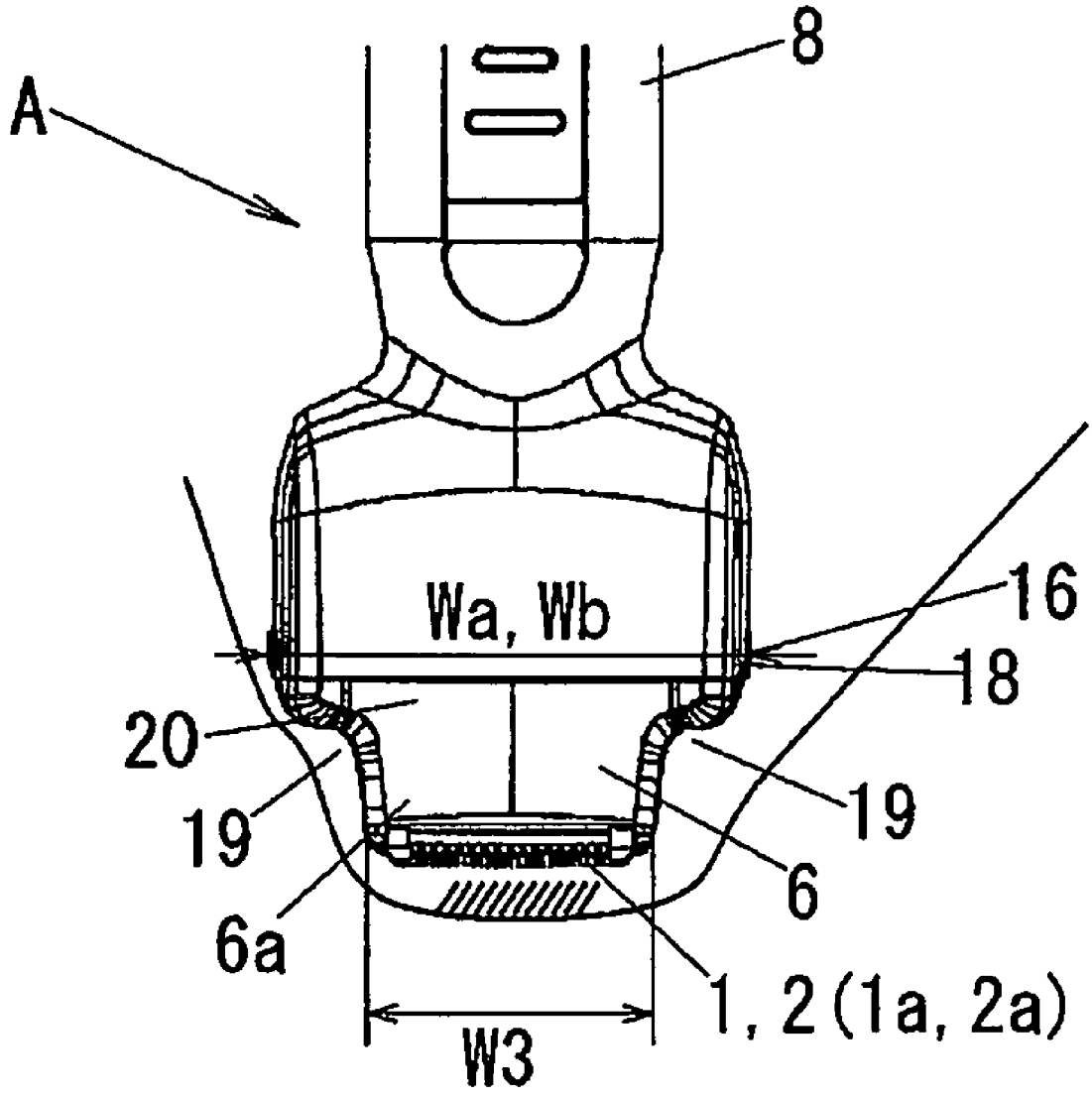
FIG. 1 is an explanatory view illustrating the state-of-use of a third blade block in accordance with an embodiment of the present invention.
Figure 2A:
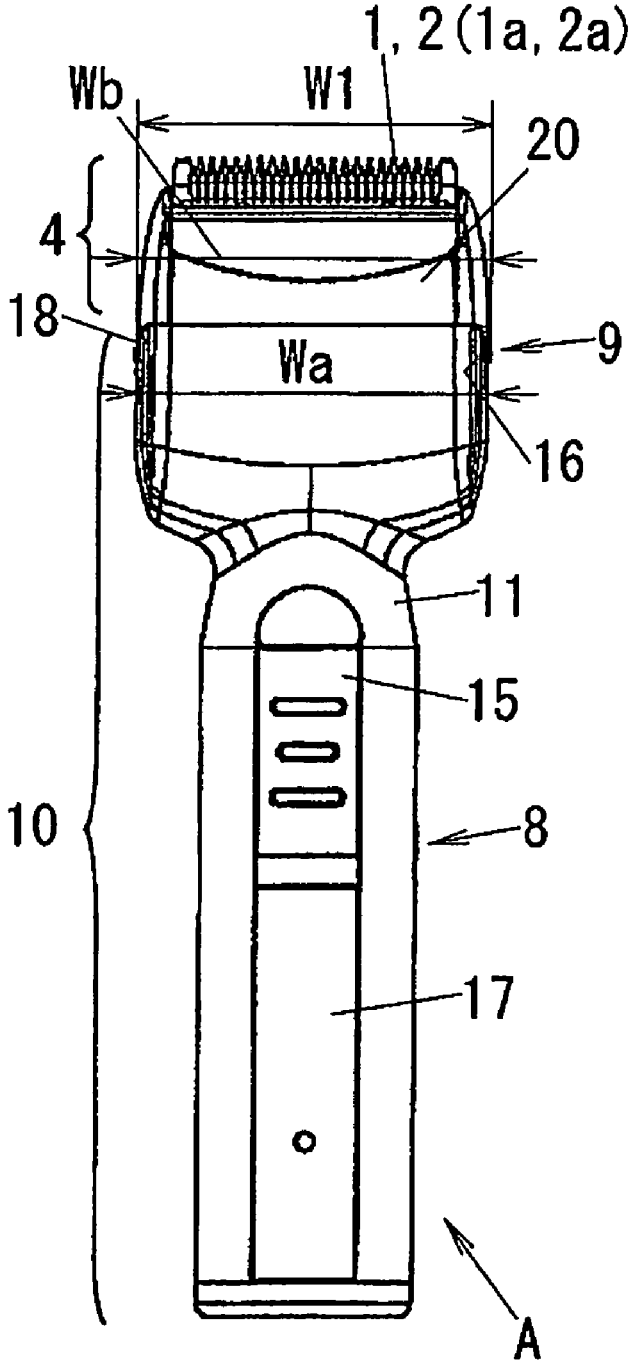
FIGS. 2A to 2C are front, side and cross sectional side views showing a use form of a hair clipper in which a first blade block is attached to a main body, respectively.
Figure 2B:
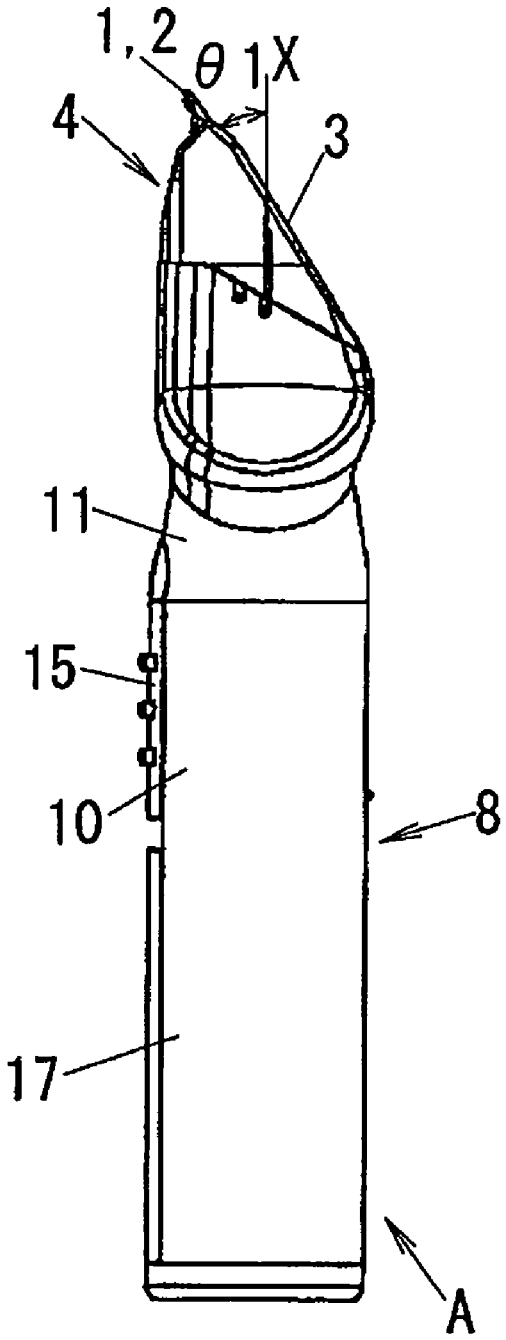
Figure 2C:
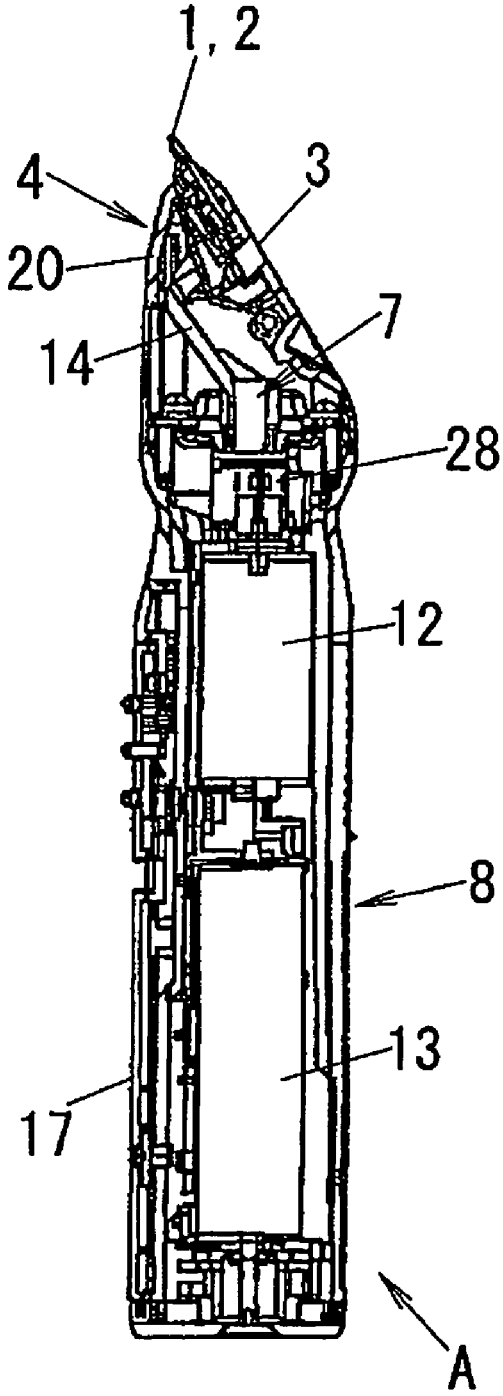
Figure 3A:
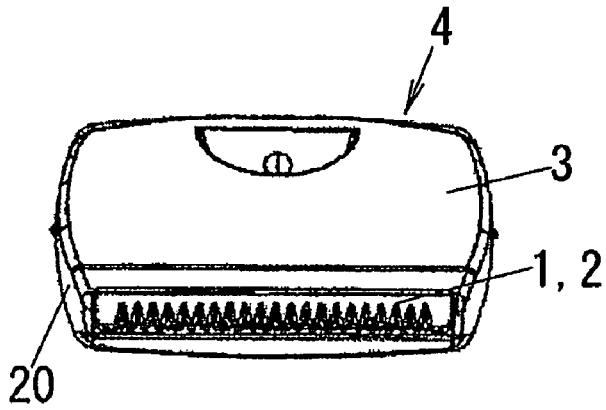
FIGS. 3A to 3E are plan, front, side, cross sectional side and perspective views of the first blade block, respectively.
Figure 3B:
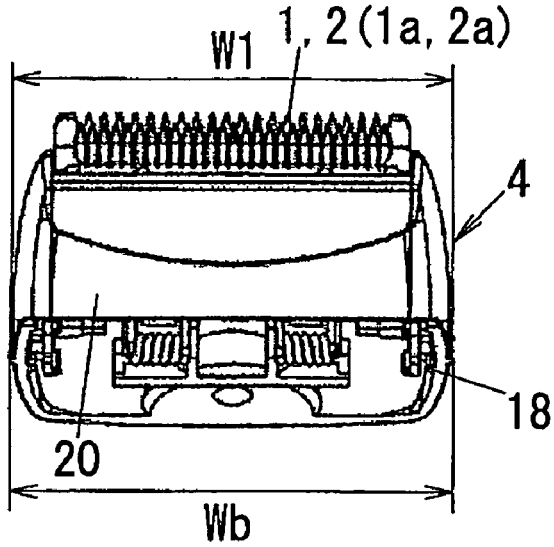
Figure 3C:
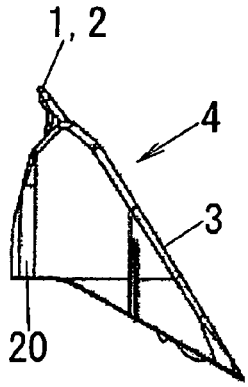
Figure 3D:
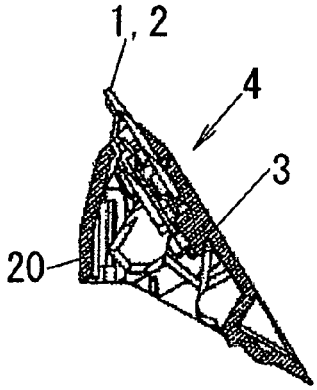
Figure 3E:
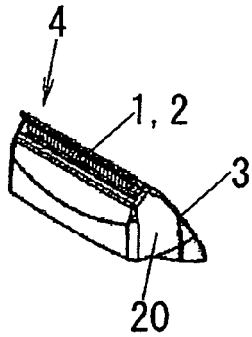
Figure 4A:
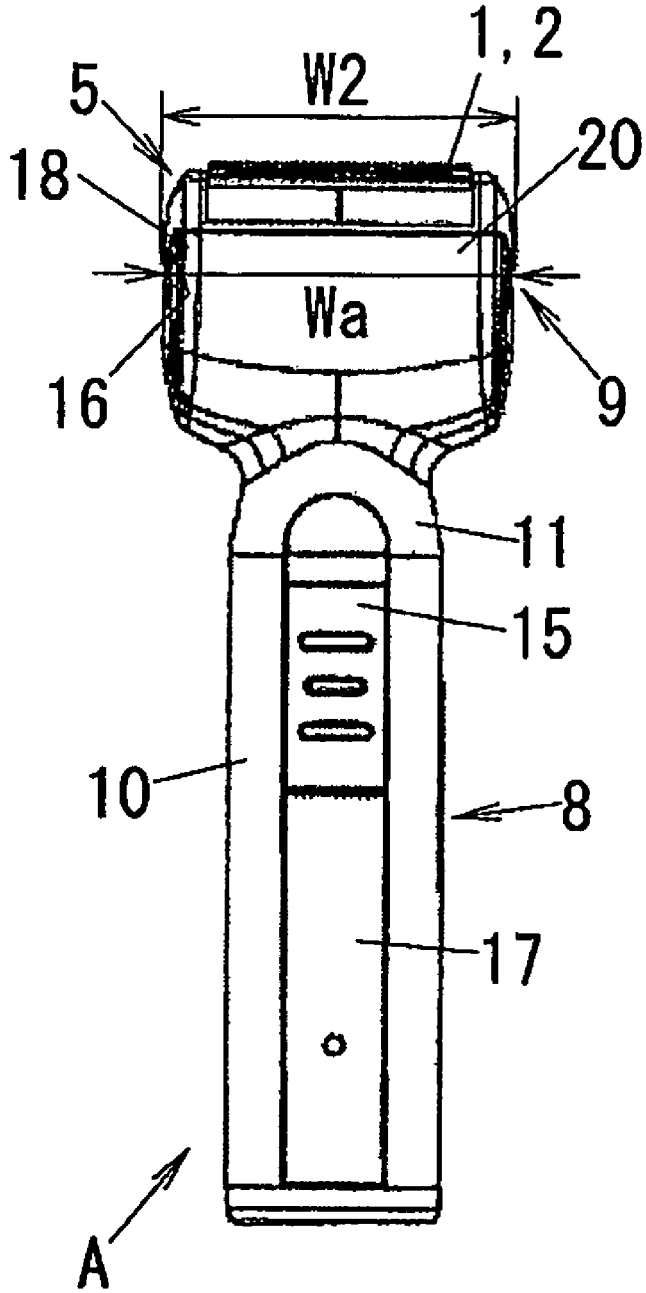
FIGS. 4A to 4C are front, side and cross sectional side views showing a use form of a hair clipper in which a second blade block is attached to the main body, respectively.
Figure 4B:
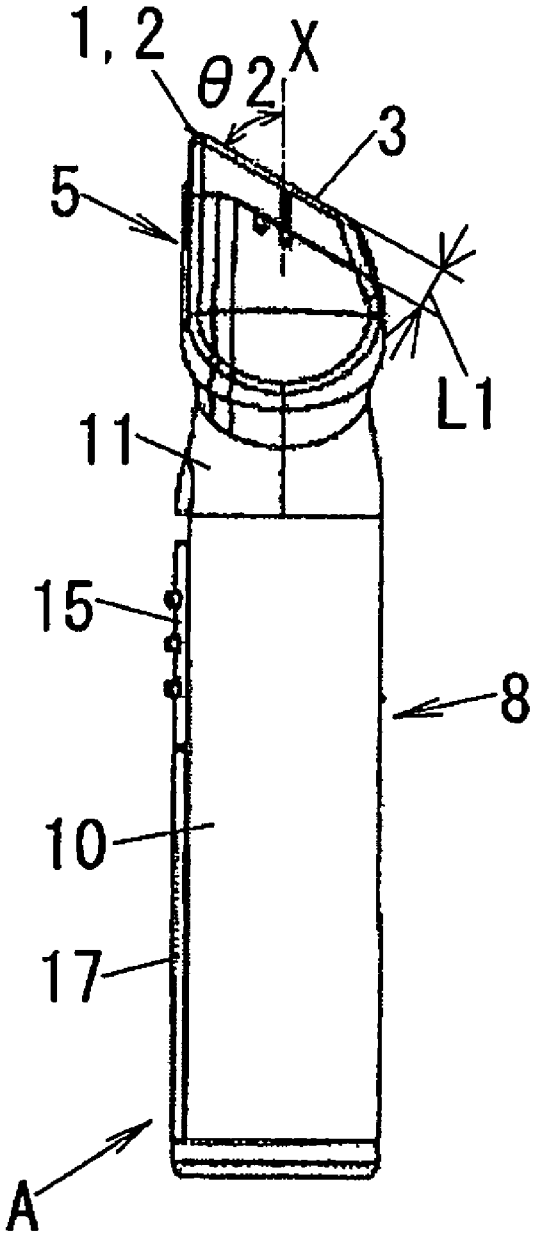
Figure 4C:
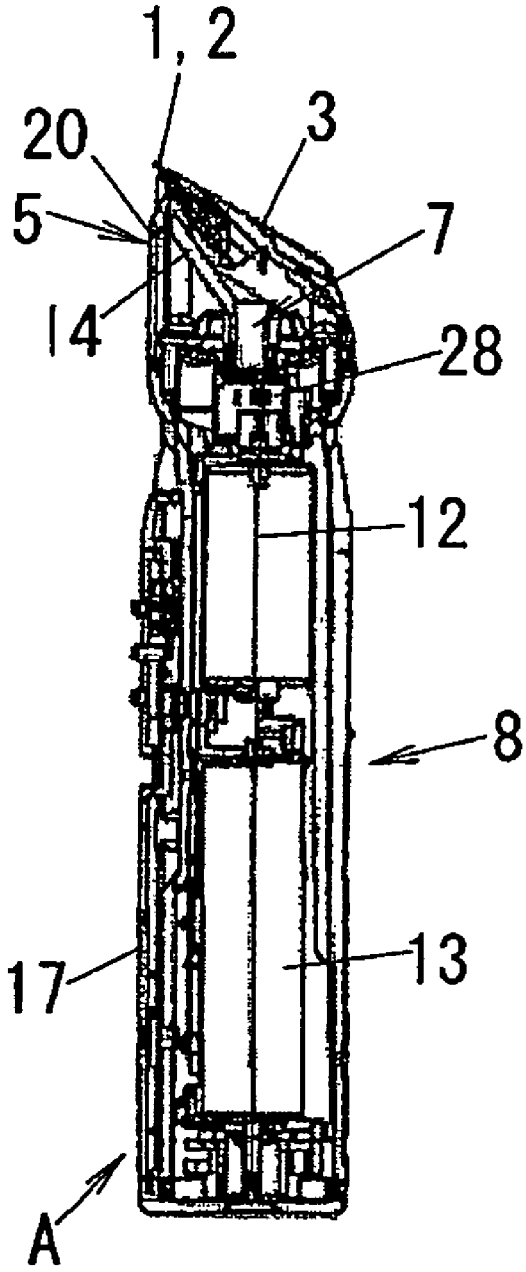
Figure 5A:
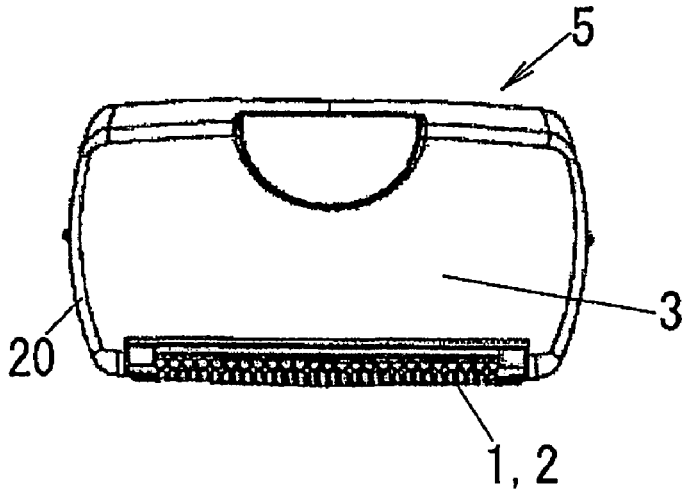
FIGS. 5A to 5E are plan, front, side, cross sectional side and perspective views of the second blade block, respectively.
Figure 5B:
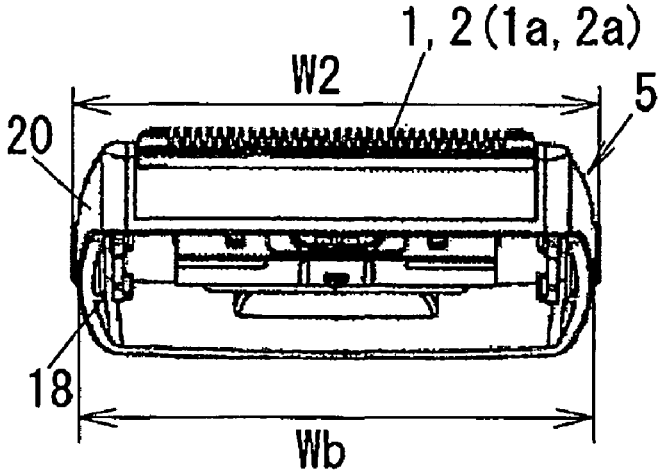
Figure 5C:
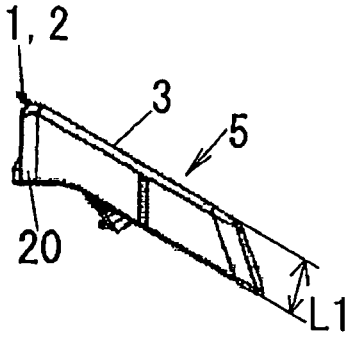
Figure 5D:
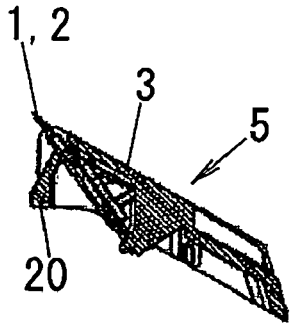
Figure 5E:
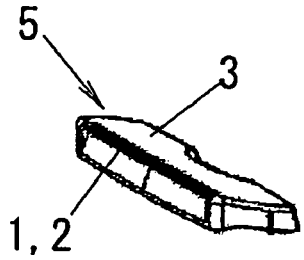
Figure 6A:
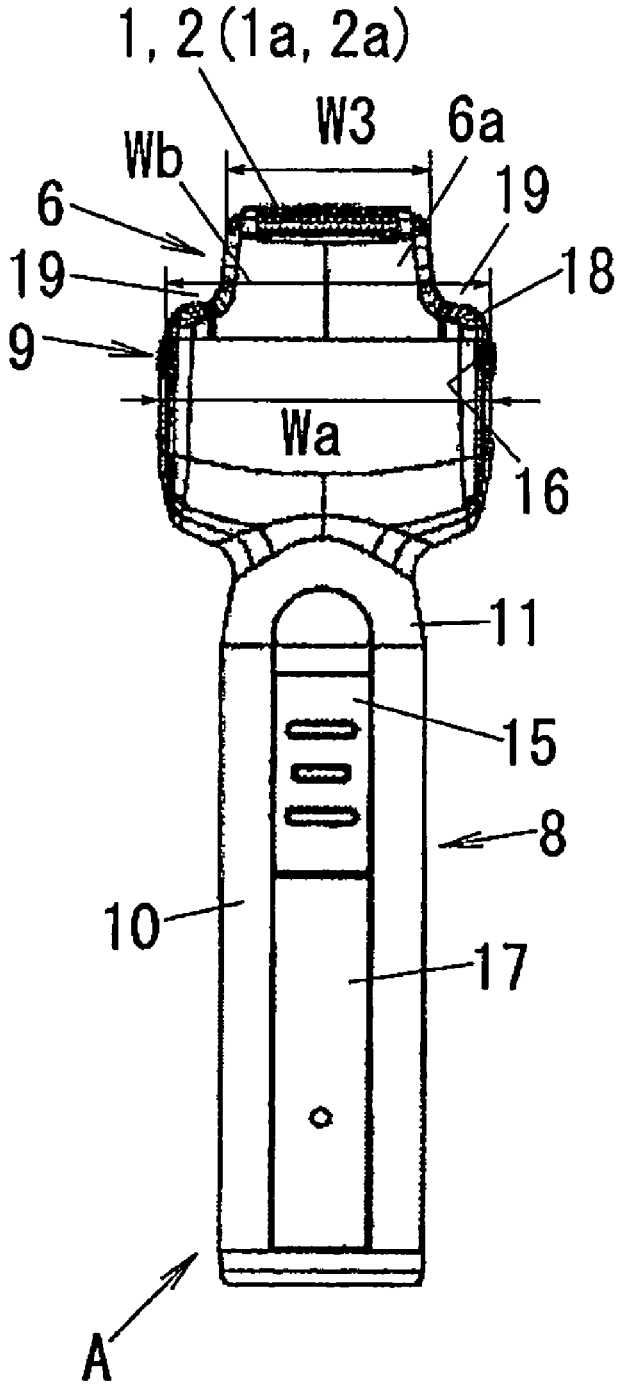
FIGS. 6A to 6C are front, side and cross sectional side views showing a use form of a hair clipper in which a third blade block is attached to the main body, respectively.
Figure 6B:
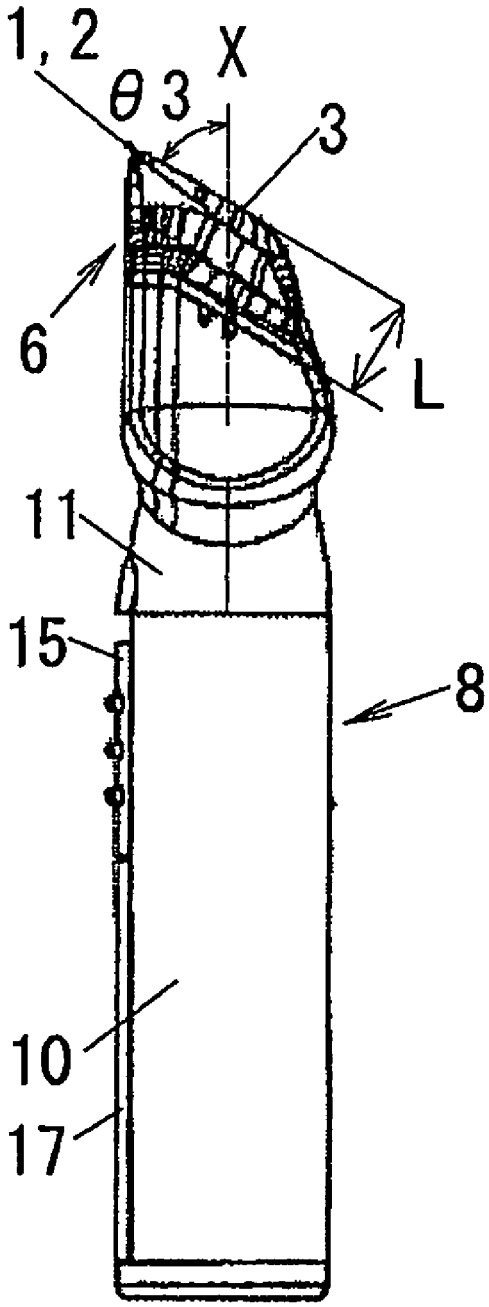
Figure 6C:
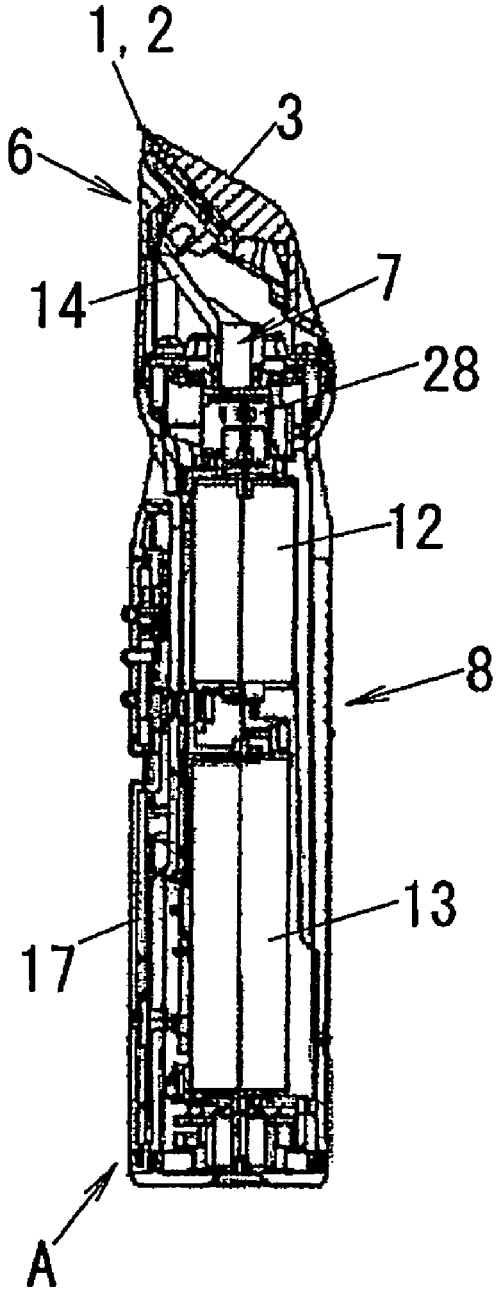
Figure 7A:
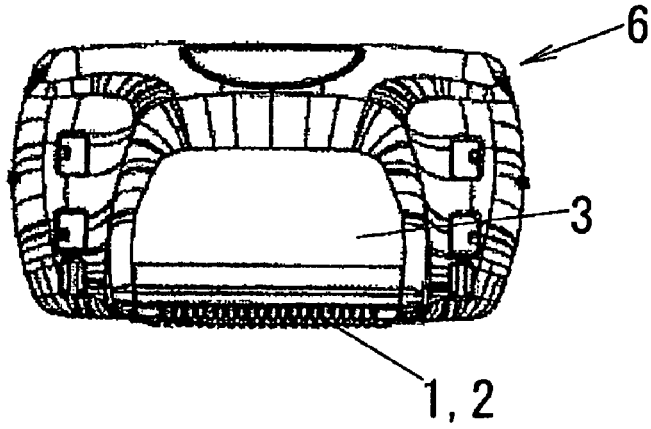
FIGS. 7A to 7E are plan, front, side, cross sectional side and perspective views of the third blade block.
Figure 7B:
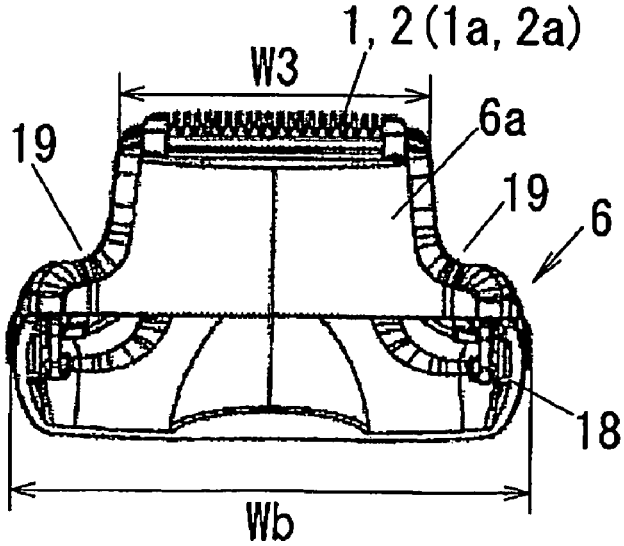
Figure 7C:
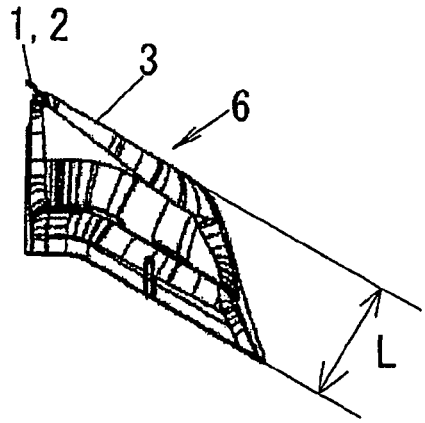
Figure 7D:
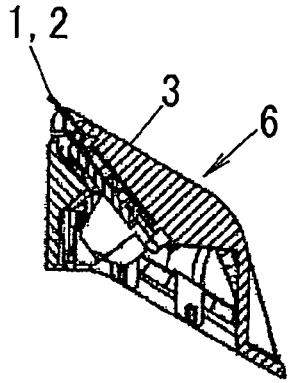
Figure 7E:
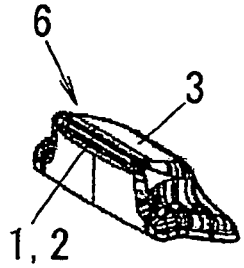

FIGS. 2A, 2B and 2C are front, side and cross sectional side views showing a hair clipper in which a first blade block is attached to a main body.

As illustrated in FIGS. 2A to 2C, a hair clipper A in accordance with an embodiment of the present invention includes a main body block 10 constituting a main body 8, and at least three blade blocks 4 (5 and 6) detachably attached to the top portion of the main body block 10. Each of the blade blocks 4 (5 and 6) has a plurality of mutually-overlapping comb-like blades 1 and 2 that make sliding contact with each other. One of the comb-like blades becomes a fixed blade unit 1*a* and the other becomes a movable blade unit 2*a*.

The main body block 10 includes a main body housing 11, a motor 12 accommodated in the housing 11 and a power source battery 13 accommodated in the housing 11 for driving the motor 12. A drive member 14 for transmitting a drive force to the movable blade unit 2*a* is connected to a shaft 28 of the motor 12 through a drive unit 7.

A switch handle 15 is provided on the surface portion of the main body housing 11. By operating the switch handle 15, a power source is turned on to reciprocate the movable blade unit 2*a* by way of the motor 12 and the drive member 14, whereby the movable blade unit 2*a* can cut hairs in cooperation with the fixed blade unit 1*a*.

Description will now be made on the blade blocks 4 (5 and 6) attached to the top portion of the main body block 10.

An attachment unit 9 for detachably attaching a selected one of the blade blocks 4 (5 and 6) to the main body block 10 includes a blade attachment portion 16 formed at the top end portion of the single main body block 10, and a counterpart attachment portion 18 formed at the base end portion of each of the blade blocks 4 (5 and 6). The counterpart attachment portion 18 can be attached to the blade attachment portion 16. In this way, it is possible to detachably attach one of the three kinds of blade blocks 4 (5 and 6) as selected. The blade attachment portion 16 is formed at, e.g., the peripheral wall portion around a top opening of the tubular main body housing 11 of the main body block 10. The counterpart attachment portion 18 includes elastic locking portions 27 (see FIG. 8) provided, e.g., inside the opening of a blade base 20 of each of the blade blocks 4 (5 and 6). Thus, the counterpart attachment portion 18 can be detachably attached to the blade attachment portion 16 through the elastic locking portions 27. The attachment unit 9 may be modified in many different forms.

The first blade block 4 (see FIGS. 2A to 2C and 3A to 3E) is exclusively used in clipping head hairs with a high hair density. The second blade block 5 (see FIGS. 4A to 4C and 5A to 5E) is used in cutting body hairs with a relatively low hair density. The third blade block 6 (see FIGS. 6A to 6C and 7A to 7E) is exclusively used in cutting hairs present in narrow-spaced (sensitive) regions having severe irregularities such as the armpit and the genital region. That is to say, the blade blocks 4, 5 and 6 are exclusively used in adaptation to the characteristics of individual hair regions.

In a state that one of the blade blocks 4, 5 and 6 is attached to the main body block 10, the movable blade unit 2*a* is reciprocated relative to the fixed blade unit 1*a* by the reciprocating movement of the drive member 14 accommodated in the main body block 10, thereby clipping or cutting the hairs therebetween.

Features of the respective blade blocks 4, 5 and 6 will now be described.

As shown in FIGS. 2A to 2C and 3A to 3E, the first blade block 4 for head hairs is exclusively used in cutting the head hairs with a high hair density. The width W1 of the first blade block 4 is substantially as broad as the width Wa of the blade attachment portion 16 formed in the tip end portion of the main body block 10, so that the head hairs can be cut at an increased speed. The skin surface contact angle θ1 between a skin contact surface 3 formed on the bottom side of the first blade block 4 and a central axis of a grip portion 17 formed in the main body housing 11 (a longitudinal axis X of the main body 8) is set smaller than the skin surface contact angles θ2 and θ3 of the remaining blade blocks 5 and 6 which will be described later. This ensures that the hairs can be easily cut by allowing the skin contact surface 3 to smoothly follow the generally spherical skin of the head while laying down the hair clipper A.

Referring to FIGS. 4A to 4C and 5A to 5E, as in the first blade block 4, the width W2 of the second blade block 5 for body hairs is substantially the same as the width Wa of the blade attachment portion 16 of the main body block 10, so that the hairs existing in broad regions such as the abdomen, the chest and the back can be cut. The skin surface contact angles θ2 of the second blade block 5 is set greater than the skin surface contact angle θ1 of the first blade block 4. This makes sure that the hairs existing in the above-noted regions can be easily cut by erecting the hair clipper A.

As can be seen in FIGS. 1, 6A to 6C and 7A to 7E, the third blade block 6 for the sensitive regions is designed to cut the hairs in the regions, such as the armpit and the genital region, having severe irregularities and existing within a space narrowed by the arms or the legs. Therefore, the width of the third blade block 6, i.e., the width of the operating portion 6*a* including the fixed blade unit 1*a*, the movable blade unit 2*a* and the skin contact surface 3, i.e., the cutting width W3, is set sufficiently smaller than the width Wa of the blade attachment portion 16 of the main body block 10 and the width Wb of the counterpart attachment portion 18. Accordingly, as compared to a case of a blade block having an increased width just like the first blade block 4 and the second blade block 5, this ensures that the hair clipper A can concentratedly shave a narrow-spaced region without suffering from hindrance of the corner portions of the third blade block 6.

The counterpart attachment portion 18 of the third blade block 6 has substantially the same width as the width Wa of the common blade attachment portion 16 formed at the main body housing 11. When viewed from the front of the third blade block 6, the third blade block 6 has indented portions 19 on the opposite sides thereof. This allows the hair clipper A to be easily used without interfering with a bulged body portion present in the hair regions, such as the armpit and the genital region, which are severely irregular and narrow-spaced by the arms or the legs.

Furthermore, the distance L (see FIGS. 6B and 7C) between the skin contact surface 3 of the third blade block 6 and the counterpart attachment portion 18 attached to the main body 8 is set greater than the corresponding length L1 (see FIG. 4B) available in the blade block 5 so that the skin contact surface 3 can be located distant from the counterpart attachment portion 18 attached to the main body 8, thereby preventing the corner portions of the counterpart attachment portion 18 from hindering the haircut operations. Such a configuration can be attained by, e.g., increasing the thickness of a resin-molded body formed in the blade base 20 of the third blade block 6 on the side of the skin contact surface 3.

Figure 8:
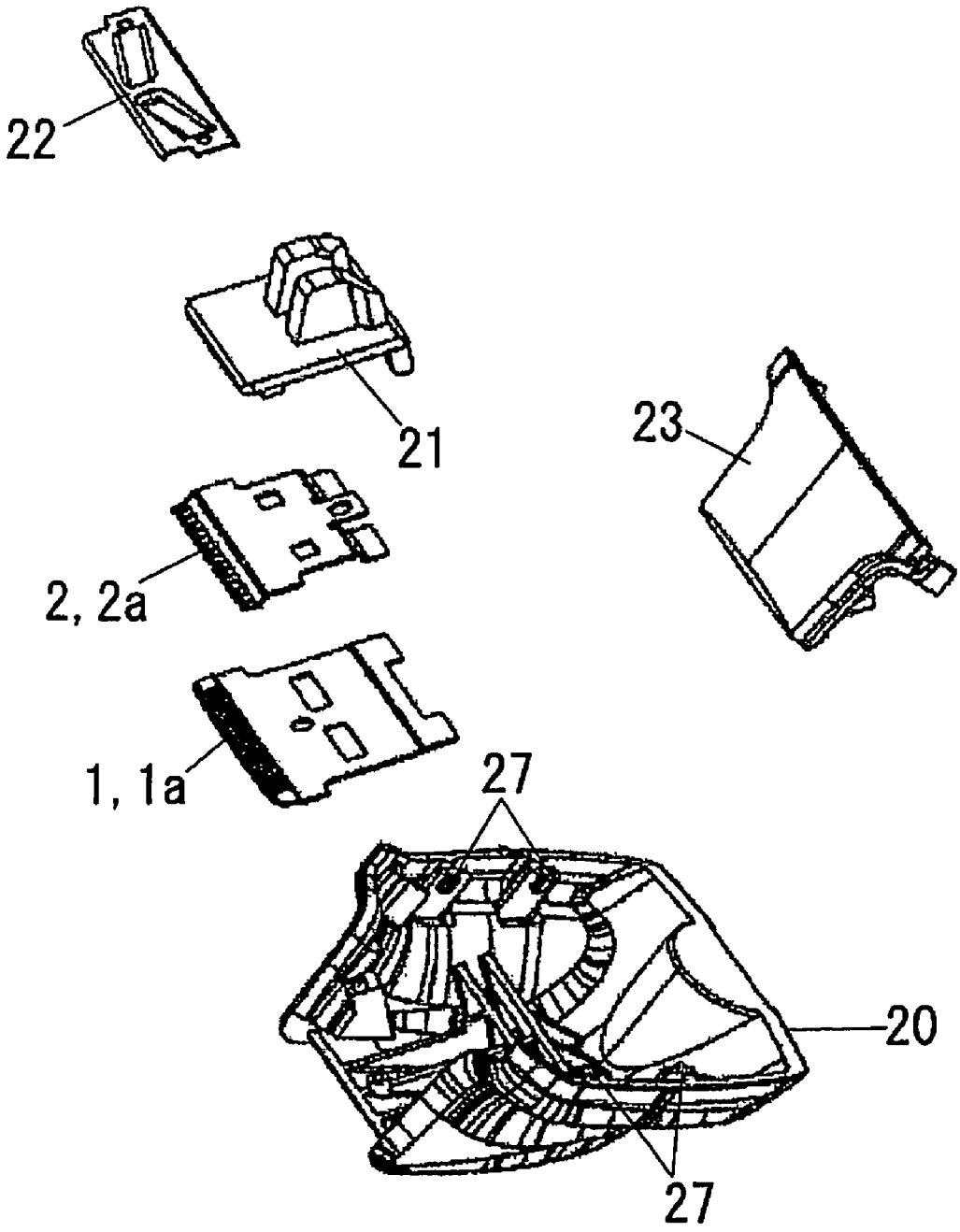
FIG. 8 is an exploded perspective view showing the third blade block.

FIG. 8 shows one example of the third blade block 6. In this example, the third blade block 6 is configured by fixing the comb-like blade 1 to the blade base 20 as the fixed blade unit 1*a*, attaching the comb-like blade 2 to the guide plate 21 as the movable blade unit 2*a*, mounting the guide plate 21 to the blade base 20 movably in a crosswise direction and allowing a biasing spring 22 to press the movable blade unit 2*a* against the fixed blade unit 1*a*. This configuration holds true for the first and second blade blocks 4 and 5. When the third blade block 6 of this configuration is attached to the main body block 10, the drive member 14 of the main body 8 is coupled to the guide plate 21, so that the movable blade unit 2*a* can make reciprocating movement relative to the fixed blade unit 1*a* by operating the drive member 14. Reference numeral 23 designates a cover. Such a configuration of the third blade block 6 is well-known in the art and applicable to the first and second blade blocks 4 and 5. Alternatively, other configurations may be employed in place thereof.

The hair clipper A configured as above includes the three blade blocks 4, 5 and 6 which may be selected and used in combination with the single main body 8. In such a case, the skin surface contact angle θ2 of the second blade block 5 between the longitudinal axis X of the main body 8 and the skin contact surface 3 is acute and is greater than that of the first blade block 4. Thus, the second blade block 5 can be erected at an angle greater than that of the first blade block 4 to cut the hairs. The first blade block 4 is used in cutting the hairs of the generally spherical head, while the second blade block 5 is used in cutting the hairs of the hands, the legs, the chest, the torso and the like. This makes it easy to use the first and the second blade blocks 4 and 5.

The third blade block 6 has substantially the same skin surface contact angle θ3 as that of the second blade block 5 so that it can be used with ease. With the third blade block 6, the cutting width W3 of the comb-like blades 1 and 2 is narrower than that of the first and second blade blocks 4 and 5. Therefore, the sensitive regions such as the armpit and the genital region, which are irregular and narrow-spaced, can be concentratedly shaved as desired without contact of the crosswise opposite ends of the comb-like blades 1 and 2 with the user's body which could hinder the haircut operation. This makes it possible to increase the efficiency of haircut operation.

Further, with the third blade block 6, the width (cutting width W3) of the operating portion 6*a* including the comb-like blades 1 and 2 and the skin contact surface 3 is set smaller than the width Wb of the counterpart attachment portion 18 attached to the main body 8. In other words, the third blade block 6 has the indented portions 19 at the opposite sides thereof. This makes it possible to avoid the third blade block 6 from contacting a bulged body portion present in the irregular and narrow-spaced hair regions, such as the armpit and the genital region, thereby allowing the hair clipper A to be used with ease.

Furthermore, the distance L between the skin contact surface 3 of the third blade block 6 and the counterpart attachment portion 18 of the third blade block 6 attached to the main body 8 is set greater than the distance L1 between the skin contact surface 3 of the second blade block 5 and the counterpart attachment portion 18 of the second blade block 6 attached to the main body 8. Therefore, the counterpart attachment portion 18 of the third blade block 6 attached to the main body 8 can be kept distant from the skin when the skin contact surface 3 of the third blade block 6 is brought into contact with the skin. This makes it possible to concentratedly shave a deeply recessed region as desired while the haircut operation is not hindered by the counterpart attachment portion 18 having an increased width.

As described above, the hair clipper A which is easy to use and able to rapidly perform haircut can be realized by providing the single main body 8 with the first blade block 4 for head hairs, the second blade block 5 for body hairs or the third blade block 6 for sensitive regions specially designed in adaptation to hair regions of severe irregularities.

Figure 9A:
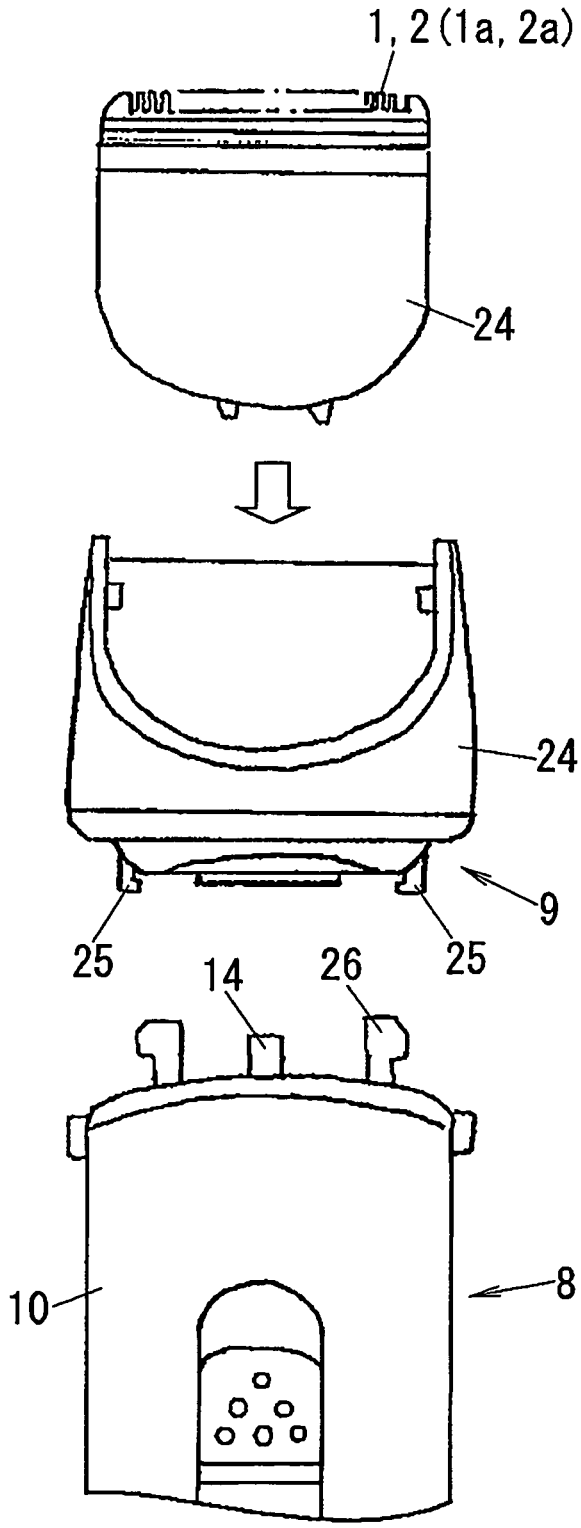
FIG. 9A is an explanatory view illustrating an operation for attaching a blade block of another embodiment to the main body and FIG. 9B is a schematic front view showing the blade block.
Figure 9B:
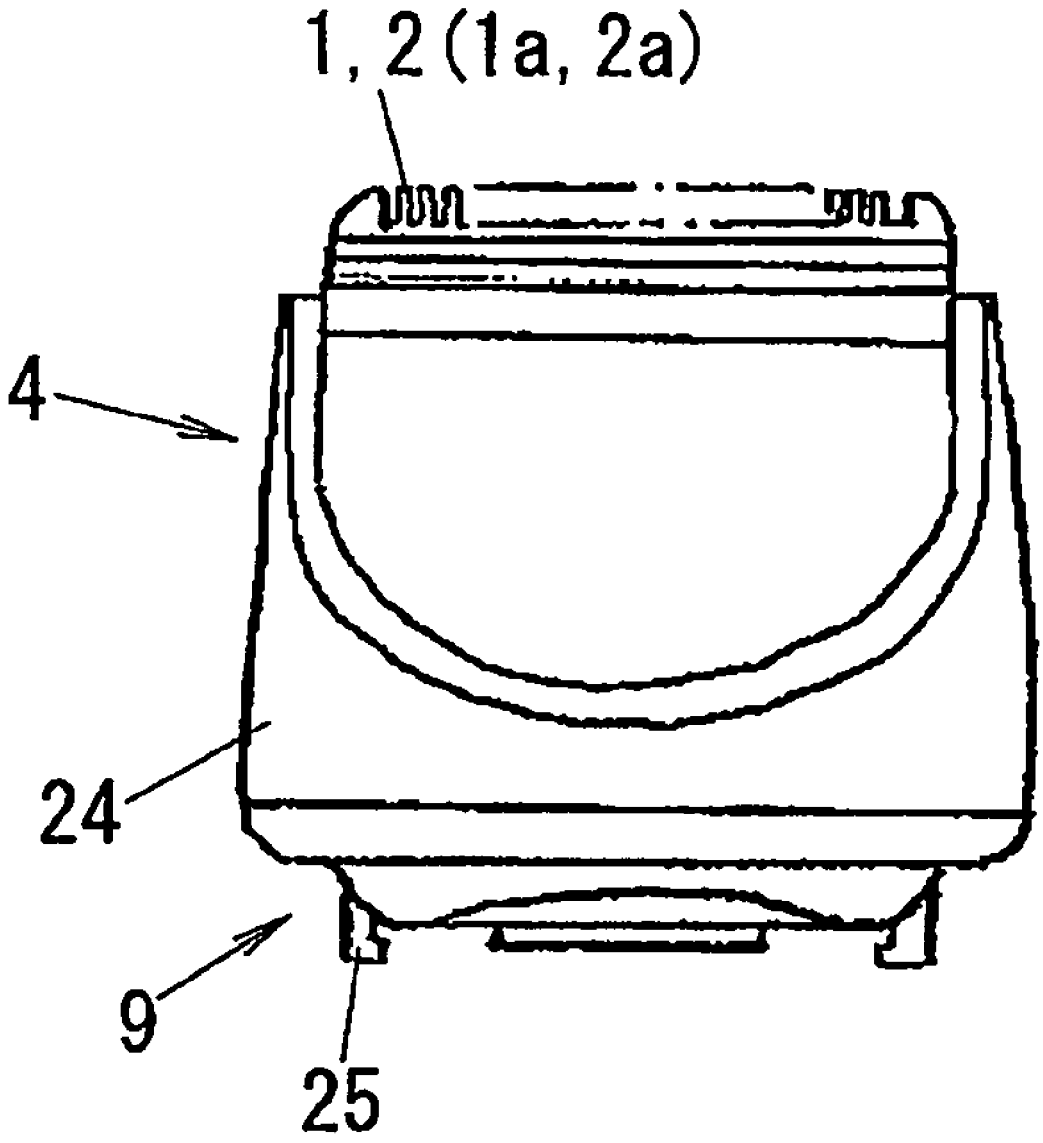

In the present invention, the blade blocks 4, 5 and 6 are intended to mean those blocks including a plurality of comb-like blades 1 and 2 mutually overlapped to make sliding contact with each other. The blade blocks 4, 5 and 6 may be of any type as long as they can be detached from the main body 8 and readily replaced by a user. For example, as shown in FIGS. 9A and 9B, each of the blade blocks 4, 5 and 6 may be configured to include a blade base 24 and comb-like blades 1 and 2. The blade base 24 is provided with, e.g., a fixed hook 25, separably coupled to, e.g., a movable hook 26 of the main body 8. The comb-like blade 2 as a movable blade unit is driven by the drive member 14 of the main body 8.

While the invention has been shown and described with respect to the embodiments, it will be understood by those skilled in the art that various changes and modifications may be made without departing from the scope of the invention as defined in the following claims.

What is claimed is:

1. A hair clipper, comprising:

at least three blade blocks each including a plurality of comb-like blades mutually overlapped for making sliding contact with each other, each of the blade blocks having a skin contact surface generally parallel to a projecting direction of the comb-like blades; and an elongated main body including a drive unit for reciprocating at least one of the comb-like blades, wherein the main body includes an attachment unit for detachably attaching a selected one of the plurality of blade blocks to the main body, wherein the blade blocks include a first blade block, a second blade block whose skin surface contact angle between a longitudinal axis of the main body and the skin contact surface is acute and is greater than a skin surface contact angle of the first blade block, and a third blade block having a skin surface contact angle which is substantially the same as the skin surface contact angle of the second blade block, the third blade block having a cutting width smaller than a cutting width of the first blade block and the second blade block, and wherein the third blade block has a counterpart attachment portion attached to the main body and an operating portion including the comb-like blades and the skin contact surface, the operating portion having a width smaller than a width of the counterpart portion.

2. The hair clipper of claim 1, wherein the third blade block has a distance between the skin contact surface and its counterpart attachment portion attached to the main body greater than a corresponding distance of the first blade block and the second blade block.

3. A hair clipper, comprising:

at least three blade blocks each including a plurality of comb-like blades mutually overlapped for making sliding contact with each other, each of the blade blocks having a skin contact surface generally parallel to a projecting direction of the comb-like blades; and an elongated main body including a drive unit for reciprocating at least one of the comb-like blades, wherein the main body includes an attachment unit for detachably attaching a selected one of the plurality of blade blocks to the main body, wherein the blade blocks include a first blade block, a second blade block whose skin surface contact angle between a longitudinal axis of the main body and the skin contact surface is acute and is greater than a skin surface contact angle of the first blade block, and a third blade block having a skin surface contact angle which is substantially the same as the skin surface contact angle of the second blade block, the third blade block having a cutting width smaller than a cutting width of the first blade block and the second blade block, and wherein the third blade block has a counterpart attachment portion attached to the main body and an operating portion including the comb-like blades and the skin contact surface, and indented portions are formed on opposite sides of the third blade block.

4. The hair clipper of claim 3, wherein the third blade block has a distance between the skin contact surface and the counterpart attachment portion greater than a corresponding distance of the first blade block and the second blade block.

5. The hair clipper of claim 3, wherein the indented portions are formed at a side of the operating portion.

6. A hair clipper, comprising:

at least three blade blocks each including a plurality of comb-like blades mutually overlapped for making sliding contact with each other, each of the blade blocks having a skin contact surface generally parallel to a projecting direction of the comb-like blades; and an elongated main body including a drive unit for reciprocating at least one of the comb-like blades, wherein the main body includes an attachment unit for detachably attaching a selected one of the plurality of blade blocks to the main body, wherein the blade blocks include a first blade block, a second blade block whose skin surface contact angle between a longitudinal axis of the main body and the skin contact surface is acute and is greater than a skin surface contact angle of the first blade block, and a third blade block having a skin surface contact angle which is substantially the same as the skin surface contact angle of the second blade block, the third blade block having a cutting width smaller than a cutting width of the first blade block and the second blade block, and wherein the third blade block has a counterpart attachment portion attached to the main body and an operating portion including the comb-like blades and the skin contact surface, the operating portion having a width smaller than a width of the counterpart portion so that indented portions are formed on opposite sides of the third blade block.

7. The hair clipper of claim 6, wherein the third blade block has a distance between the skin contact surface and its counterpart attachment portion attached to the main body greater than a corresponding distance of the first blade block and the second blade block.

* * * * *